US008887599B2

(12) United States Patent
Evans

(10) Patent No.: US 8,887,599 B2
(45) Date of Patent: Nov. 18, 2014

(54) SOCKET EXTENSION

(76) Inventor: Eliot Evans, Joice, IA (US)

( * ) Notice: Subject to any disclaimer, the term of this patent is extended or adjusted under 35 U.S.C. 154(b) by 302 days.

(21) Appl. No.: 13/481,324

(22) Filed: May 25, 2012

(65) Prior Publication Data

US 2012/0297937 A1 Nov. 29, 2012

Related U.S. Application Data

(60) Provisional application No. 61/490,399, filed on May 26, 2011.

(51) Int. Cl.

| | |
|---|---|
| ***B25B 13/48*** | (2006.01) |
| ***B25B 13/06*** | (2006.01) |
| ***B25B 23/00*** | (2006.01) |
| ***B25B 13/04*** | (2006.01) |
| ***B25B 13/08*** | (2006.01) |

(52) U.S. Cl.

CPC ..... *B25B 23/0021* (2013.01); *B25B 13/04* (2013.01); *B25B 13/08* (2013.01); *B25B 13/48* (2013.01); *B25B 23/0007* (2013.01)

USPC ..... 81/177.2

(58) Field of Classification Search

USPC ..... 81/177.2, 177.85; D8/21, 29

See application file for complete search history.

(56) References Cited

U.S. PATENT DOCUMENTS

| | | | | | |
|---|---|---|---|---|---|
| 1,079,912 | A | * | 11/1913 | Cutter | 81/30 |
| 1,289,558 | A | * | 12/1918 | Sedgley | 81/124.5 |
| 1,416,461 | A | * | 5/1922 | Hance | 7/138 |
| 1,578,065 | A | * | 3/1926 | Bemus et al. | 81/61 |
| 1,724,491 | A | * | 8/1929 | Mandl | 81/60 |
| 3,875,829 | A | * | 4/1975 | Evans et al. | 81/185 |
| 4,102,375 | A | * | 7/1978 | Rossini | 81/30 |
| 4,344,340 | A | | 8/1982 | Erickson | |
| 4,960,015 | A | | 10/1990 | Mathews | |
| 5,168,782 | A | * | 12/1992 | Cromwell | 81/177.2 |
| 5,216,940 | A | * | 6/1993 | Hedden | 81/177.2 |
| 5,272,943 | A | | 12/1993 | Edwards | |
| 5,438,894 | A | * | 8/1995 | Pearce | 81/177.2 |
| 5,568,757 | A | * | 10/1996 | Lewis | 81/177.2 |
| 5,680,800 | A | | 10/1997 | Sharpe | |
| 5,927,161 | A | | 7/1999 | Clifford et al. | |
| 6,260,452 | B1 | | 7/2001 | Yu | |
| 7,055,412 | B2 | * | 6/2006 | Leighton | 81/124.4 |
| 7,089,831 | B2 | | 8/2006 | Chen | |
| 7,114,418 | B1 | | 10/2006 | Allen | |
| 7,150,208 | B2 | * | 12/2006 | Debley | 81/59.1 |
| 7,185,568 | B1 | * | 3/2007 | Vance | 81/177.2 |

(Continued)

OTHER PUBLICATIONS

5/32"×2" Hex Drive Bit Ball Detent web printout, http://www.mcfeelys.com/product/HRA-1020/x-2-Hex-Drive-Bit-Ball-Detent, printed May 26, 2011, 1 page.

*Primary Examiner* — David B Thomas

(74) *Attorney, Agent, or Firm* — Patterson Thuente Pedersen, P.A.

(57) ABSTRACT

A socket extension and related methods of utilizing a socket extension that improves upon conventional designs through the use of a shaped body allowing the socket extension to be manipulated with an appropriate tool at any point along the shaped body. Through the use of the shaped body, a user is provided multiple engagement points such that interference due to the proximity of other structures or other accessibility issues can be overcome. In addition, the shaped body presents the opportunity to utilize a plurality of tools on the same socket extension when additional force/torque is necessary to loosen and/or tighten a bolt.

12 Claims, 12 Drawing Sheets

(56) References Cited

U.S. PATENT DOCUMENTS

| | | | | |
|---|---|---|---|---|
| 7,331,261 | B2 | 2/2008 | Blizniuk et al. | |
| 7,340,984 | B2 | 3/2008 | Hsieh | |
| 8,146,461 | B1 | 4/2012 | Su | |
| 8,302,513 | B2 | 11/2012 | Evatt | |
| 8,307,743 | B2 | 11/2012 | Hsu | |
| 8,667,871 | B2 * | 3/2014 | Ahrens | 81/177.2 |
| 8,667,872 | B2 * | 3/2014 | McCullough et al. | 81/177.2 |
| 2002/0178874 | A1 * | 12/2002 | Lee | 81/177.2 |
| 2006/0191384 | A1 * | 8/2006 | Dougherty | 81/177.2 |
| 2012/0180605 | A1 * | 7/2012 | Ahrens | 81/177.2 |

* cited by examiner 100
102
103
104
106
108
110
112
114
120
122
130

SOCKET EXTENSION

RELATED APPLICATION

The present application claims the benefit of U.S. Provisional Application No. 61/490,399 filed May 26, 2011, which is incorporated herein in its entirety by reference.

FIELD OF THE INVENTION

The present invention is directed to the field of hand tools utilizing a socket for manipulating a bolt. More specifically, the present invention is directed to a socket extension including a hex cross-section extending essentially the length of the socket extension allowing a user to access and manipulate the socket extension at any point along a length of the socket extension.

BACKGROUND OF THE INVENTION

Socket extensions are well known device that allow user to utilize sockets to tighten and loosen bolts in areas that are difficult to access absent the use of the socket extension. For instance, space constraints can make it impossible to access a bolt head with a conventional socket and ratcheting wrench, wherein the use of the socket extension can move the connection point with the ratcheting wrench far enough away from the bolt head to permit connection and manipulation of the ratcheting wrench. The use of socket extensions is so well known and frequent that one or more are generally included with almost all socket kits including those offered under brand names such as Craftsman®, Stanley® and a host of other suppliers.

While conventional socket extensions do an extremely good job of moving the attachment point to a ratcheting wrench far from a restricted access area in proximity to a bolt head, there are instances wherein the connection point with the socket extension is also limited in access. As such, it would be advantageous to have an improved socket extension design providing additional options in how to access and manipulate the socket extension.

SUMMARY OF THE INVENTION

A socket extension of the present invention improves upon the design of existing socket extensions through the use of a shaped body allowing the socket extension to be manipulated with an appropriate tool at any point along the shaped body. Through the use of the shaped body, a user is provided multiple engagement points such that interference due to the proximity of other structures or other accessibility issues can be overcome. In addition, the shaped body presents the opportunity to utilize a plurality of tools on the same socket extension when additional force/torque is necessary to loosen and/or tighten a bolt.

In one aspect, the present invention comprises a socket extension having a shaped body that is continuous between a first end and a second end. Generally, the shaped body comprises a cross-section defined by a plurality of body sides allowing for manipulation with a conventional wrench design such as, for example, an open ended wrench, a box wrench, an adjustable crescent wrench and the like. In one preferred embodiment, shaped body utilized a hexagonal cross-section such that the socket extension can be formed from a standard piece of hexagonal rod. Alternatively, the shaped body can comprise additional shapes that allow access with a conventional wrench design such as, for example, square. The socket extension can be fabricated so as to include a first end with a socket attachment protuberance such that any appropriately sized socket can be attached to the socket extension based upon the size and configuration of a screw head to be manipulated. In some embodiments, a second end of the socket extension can be fabricated to include an attachment aperture for accommodating a wrench having a similarly configured wrench protuberance.

In another aspect, a socket extension of the present invention can be utilized in a method for manipulating bolts or screws where access is limited due to its location or the presence of nearby structure. Generally, the method comprises providing a socket extension having a shaped body continuously extending between first and second ends of the socket extension. Next, the method comprises attaching an appropriately sized socket to a socket attachment protuberance on the first end. Next, the method comprises placing the socket over the bolt or screw head to be manipulated. Finally, the method further comprises engaging the socket extension with a wrench at any accessible point along the shaped body. In some embodiments, the method can further comprise engaging the socket extension with a second wrench at any accessible point along the shaped body so as to allow a user to provide additional torque/force during loosening/tightening of the bolt or screw.

In yet another aspect, a wrench system can comprise the use of a socket extension having a shaped body defined between a first end and a second end. The shaped body can include an engageable cross-section defined continuously between the first end and the second end and having a plurality of body sides. The shaped body can be engaged by one or more wrenches at an point along the shaped body. In some embodiments, the first and second end can be adapted so as to have connection features allowing for operable connection to sockets and/or socket wrenches.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The present invention is more completely understood in consideration of the following detailed description of various embodiments in connection with the accompanying drawings, in which.

Figures 1, 2, 3, 4, 5, 6:
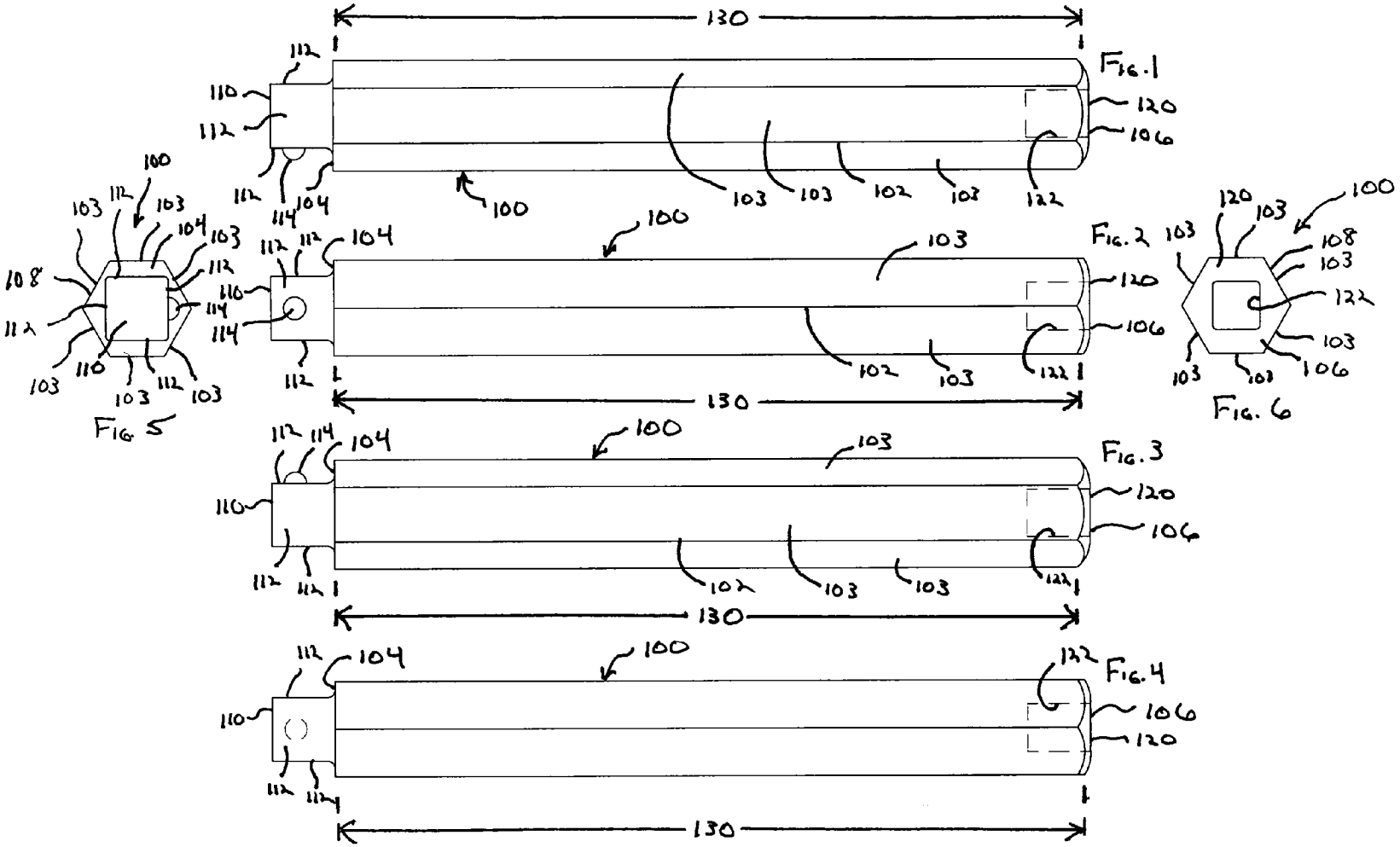
FIG. 1 is a front, partially hidden view of a socket extension according to a representative embodiment of the present invention.
FIG. 2 is a bottom, partially hidden view of the socket extension of FIG. 1.
FIG. 3 is a rear, partially hidden view of the socket extension of FIG. 1.
FIG. 4 is a top, partially hidden view of the socket extension of FIG. 1.
FIG. 5 is a first end view of the socket extension of FIG. 1.
FIG. 6 is a second end view of the socket extension of FIG. 1.
Figure 8:
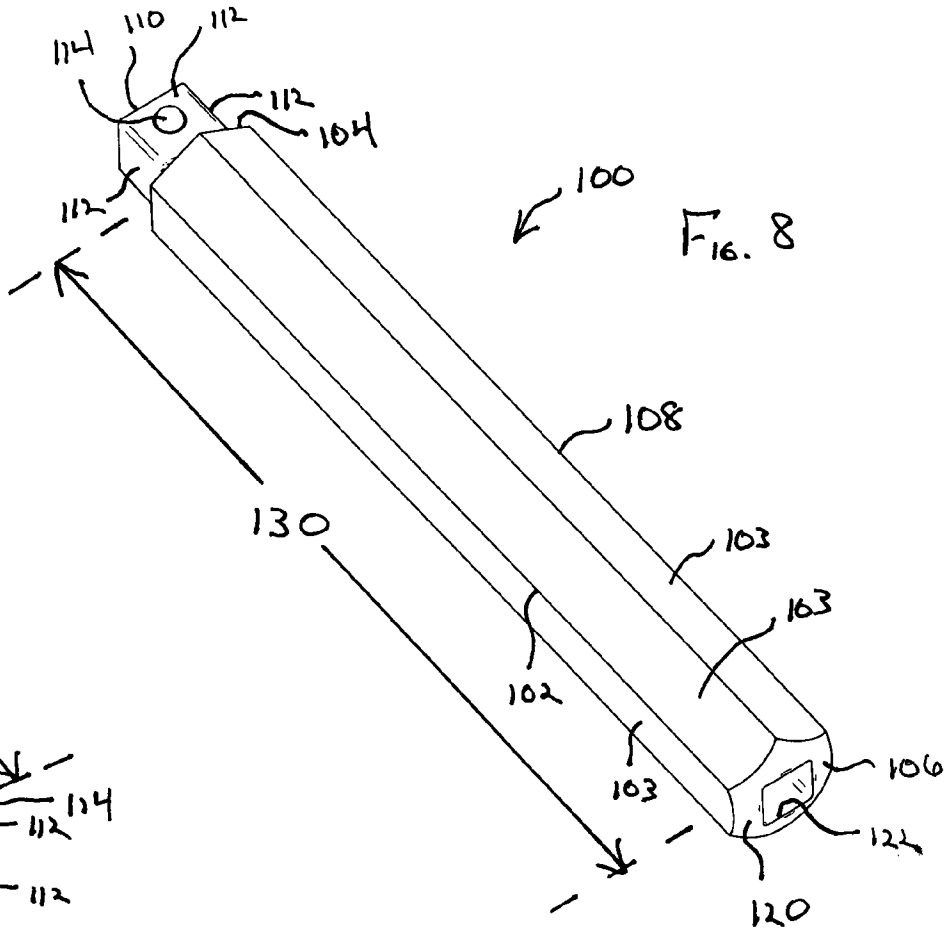
FIG. 8 is a bottom, second end perspective view of the socket extension of FIG. 1.
Figure 7:
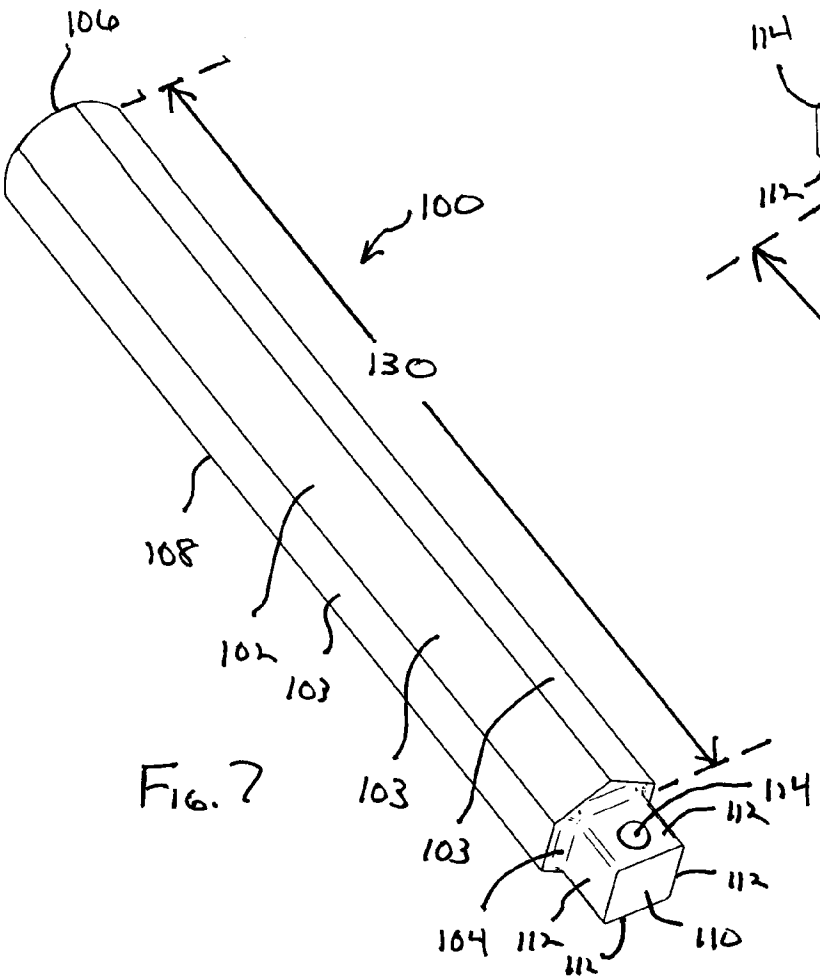
FIG. 7 is a bottom, second end perspective view of the socket extension of FIG. 1.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention as defined by the appended claims.

DETAILED DESCRIPTION OF THE DRAWINGS

As illustrated in FIGS. 1-8, a representative socket extension 100 of the present invention can comprise a socket body 102 having a first end 104 and a second end 106. Socket body 102 generally comprises an engageable body cross-section 108 having a profile defined by a plurality of body sides 103 allowing conventional wrenches such as, for example, box wrenches, open ended wrenches, adjustable crescent wrenches and the like to grab and engage the body cross-section 108. Socket extension 102 can be fabricated of suitable materials including, example, mild steel, stainless steel, chrome-vanadium alloys and other conventional wrench materials.

As seen in FIGS. 1-5, 7 and 8, socket extension 100 can be machined or cast to include an attachment protuberance 110 at first end 104. Attachment protuberance 110 is generally configured with a plurality of sides 112, most typically four sides 112, for attachment to standard English and metric sockets. Attachment protuberance 110 can include a spring loaded ball lock 114 on one of sides 112 so as to provide additional friction and retain attachment of the socket to the attachment protuberance 110.

Referring to FIGS. 1-4 and 6-8, second end 106 can comprise a variety of configurations. For example, second end 106 can comprise a flat surface 120 over which a socket or box wrench can be placed. Alternatively, second end 106 can include an attachment aperture 122 positioned on flat surface 120 wherein the attachment aperture 122 is configured to receive and couple to a wrench attachment protuberance.

Referring to FIGS. 1-8, socket extension 100 is fabricated such that engageable body cross-section 108 is constant for an engagement length 130 extending between first end 104 and second end 106. For example, engageable body cross-section 108 can have a hexagonal or six-sided cross-section that is continuous between first end 104 and second end 106. By maintaining engageable cross-section 108 in a continuous fashion between first end 104 and second end 106 along the entire engagement length 108, a user has multiple places for attaching a wrench to the socket extension 100 and is able to manipulate the socket extension 100 at the most convenient location as discussed in the following paragraphs.

Figure 9:
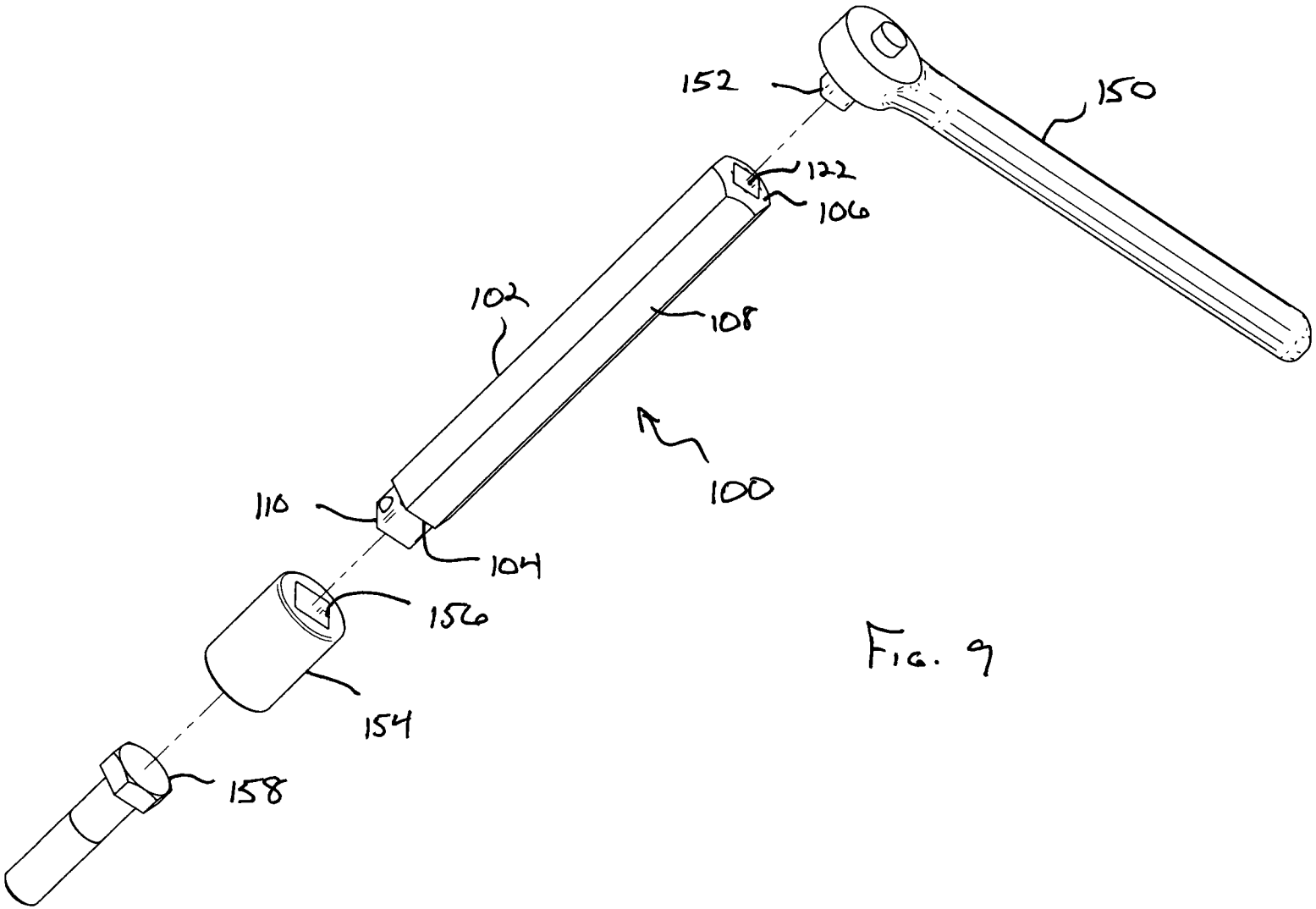
FIG. 9 is an exploded, perspective view of the socket extension of FIG. 1 being utilized to manipulate a bolt with a ratcheting wrench according to an embodiment of the present invention.
Figure 10:
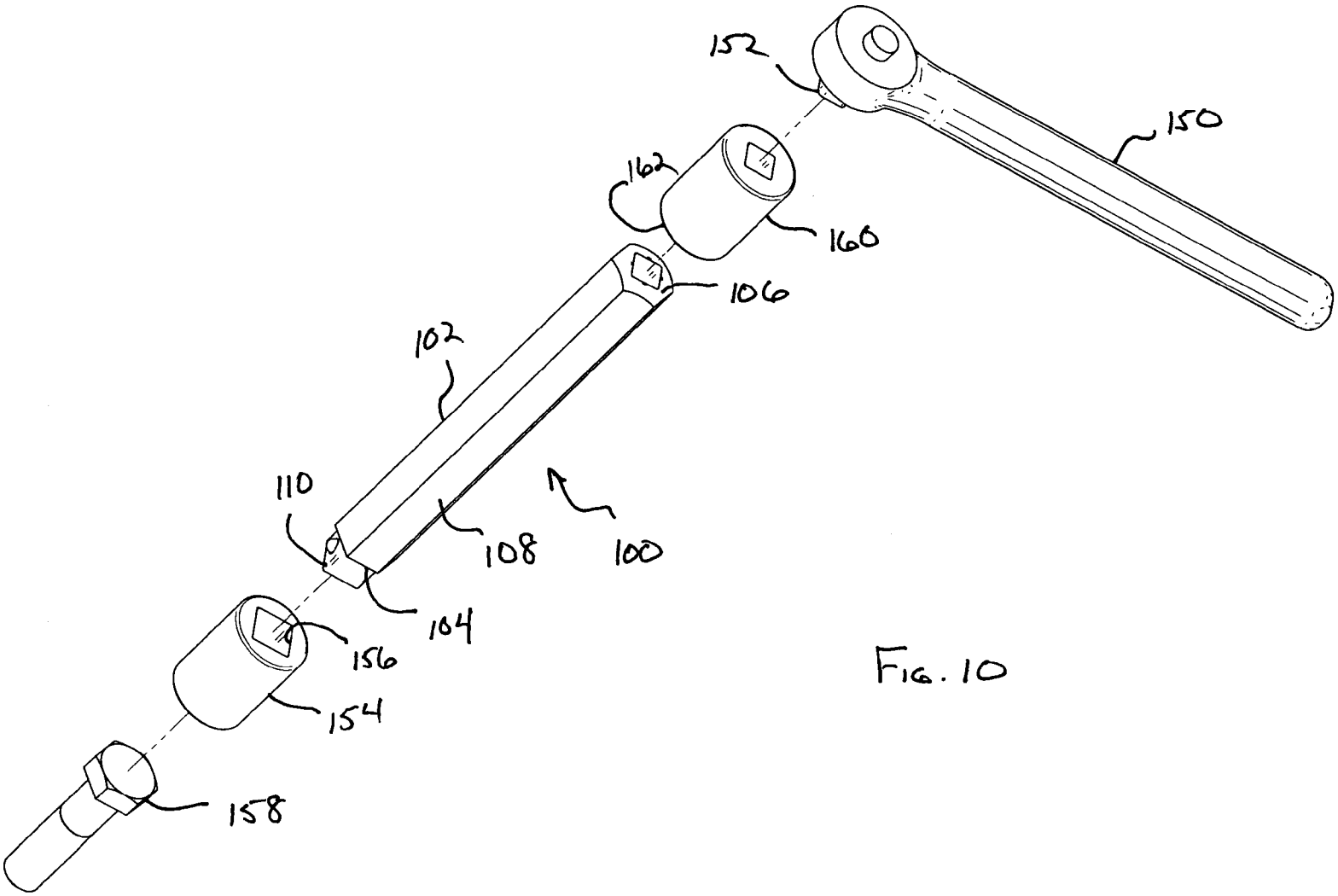
FIG. 10 is an exploded, perspective view of the socket extension of FIG. 1 being utilized to manipulate a bolt with a ratcheting wrench according to an embodiment of the present invention.
Figure 12:
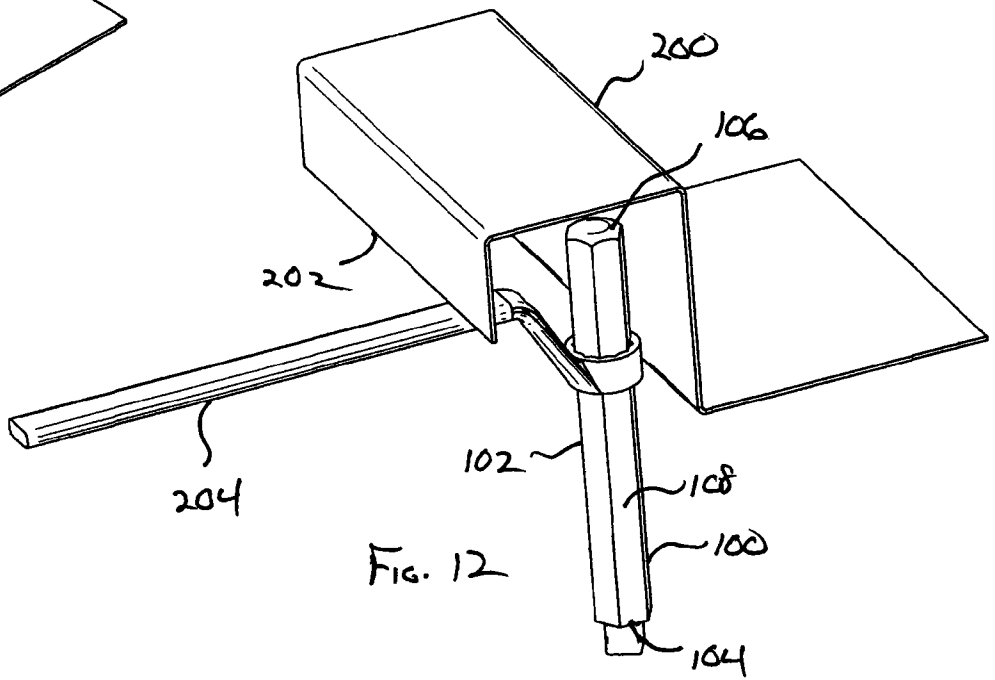
FIG. 12 is a front, perspective view of the socket extension of FIG. 1 being utilized behind the wall of FIG. 11.
Figure 11:
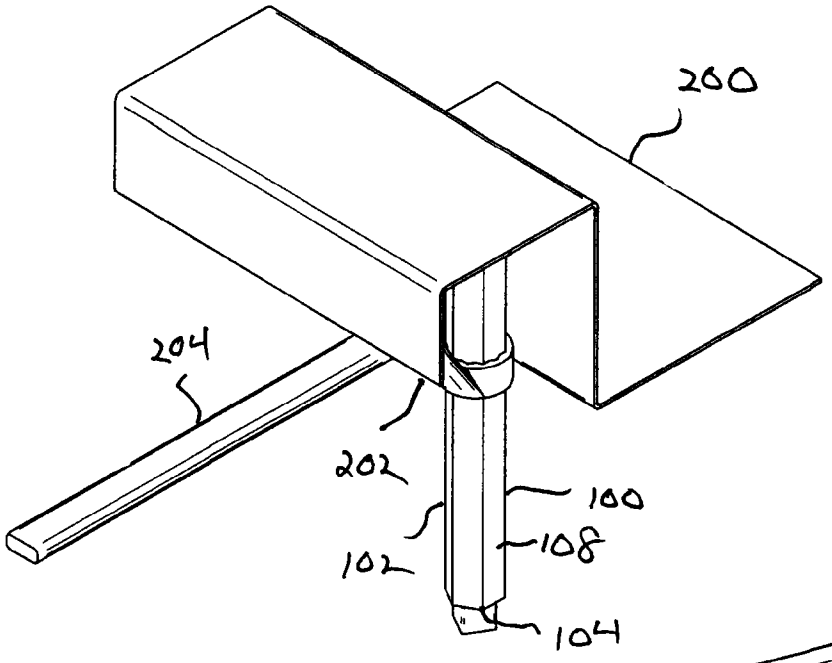
FIG. 11 is a front, perspective view of the socket extension of FIG. 1 being utilized behind a wall according to an embodiment of the present invention.
Figure 14:
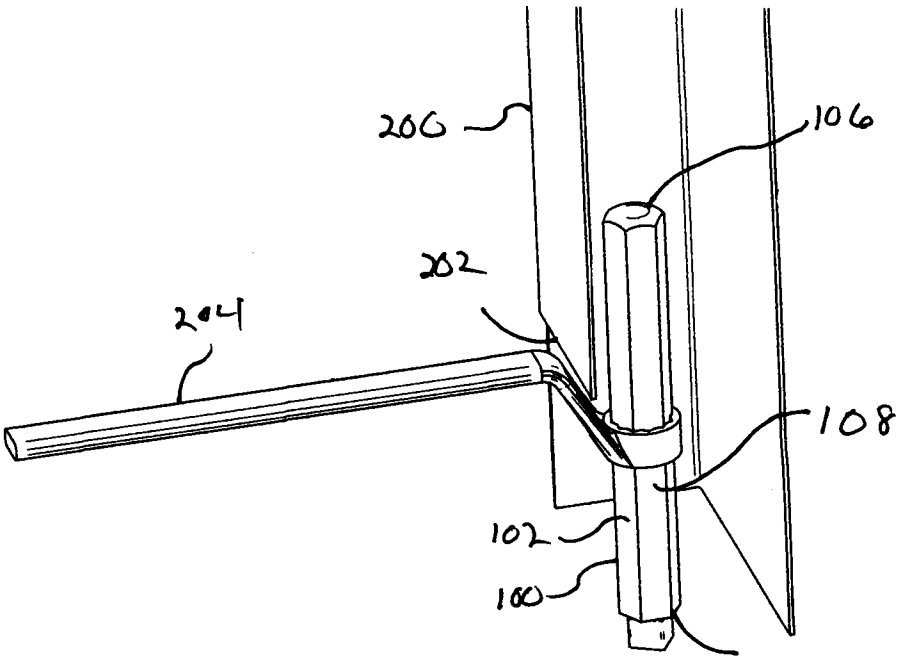
FIG. 14 is a side, perspective view of the socket extension of FIG. 1 being utilized behind the wall of FIG. 13.
Figure 13:
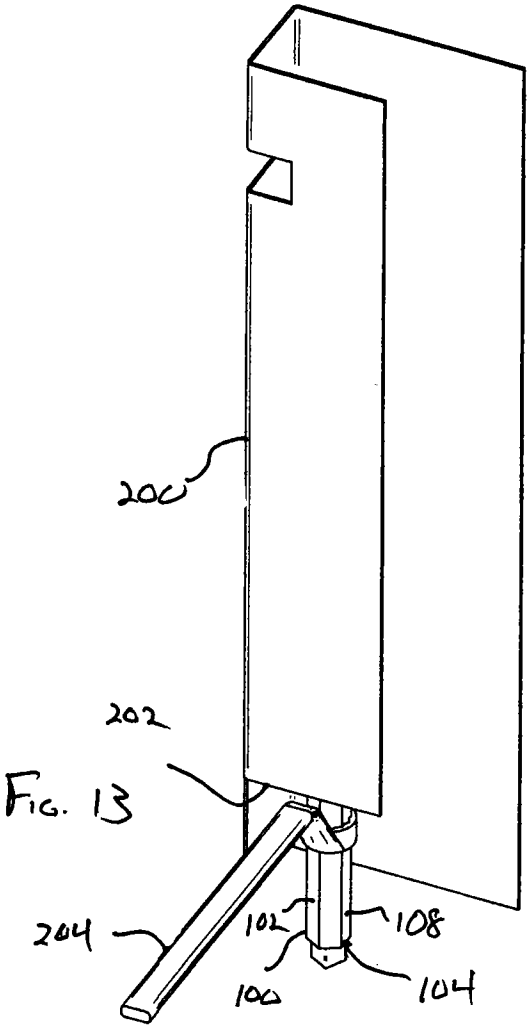
FIG. 13 is a front, perspective view of the socket extension of FIG. 1 being utilized behind a wall according to an embodiment of the present invention.
Figure 16:
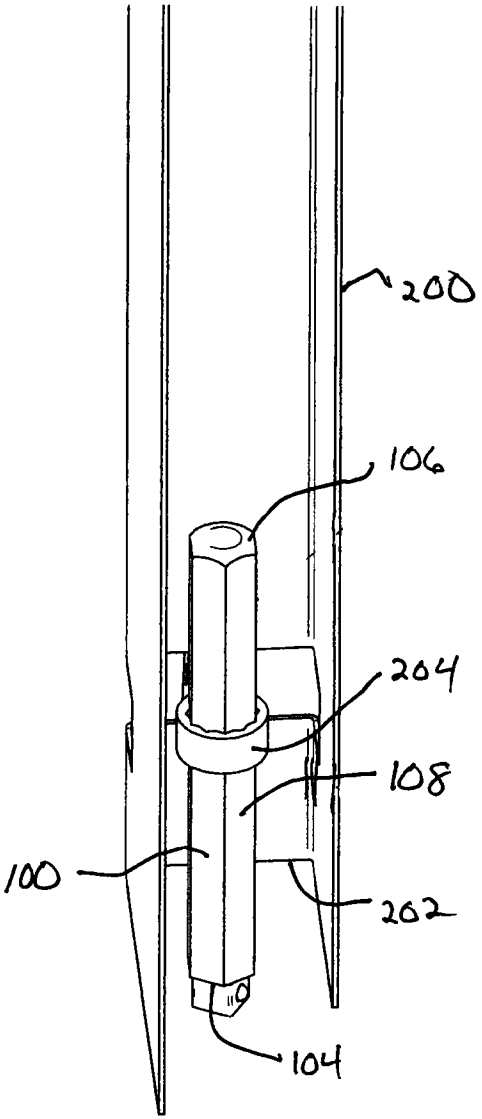
FIG. 16 is a rear, perspective view of the socket extension of FIG. 1 being utilized behind the wall of FIG. 15.
Figure 15:
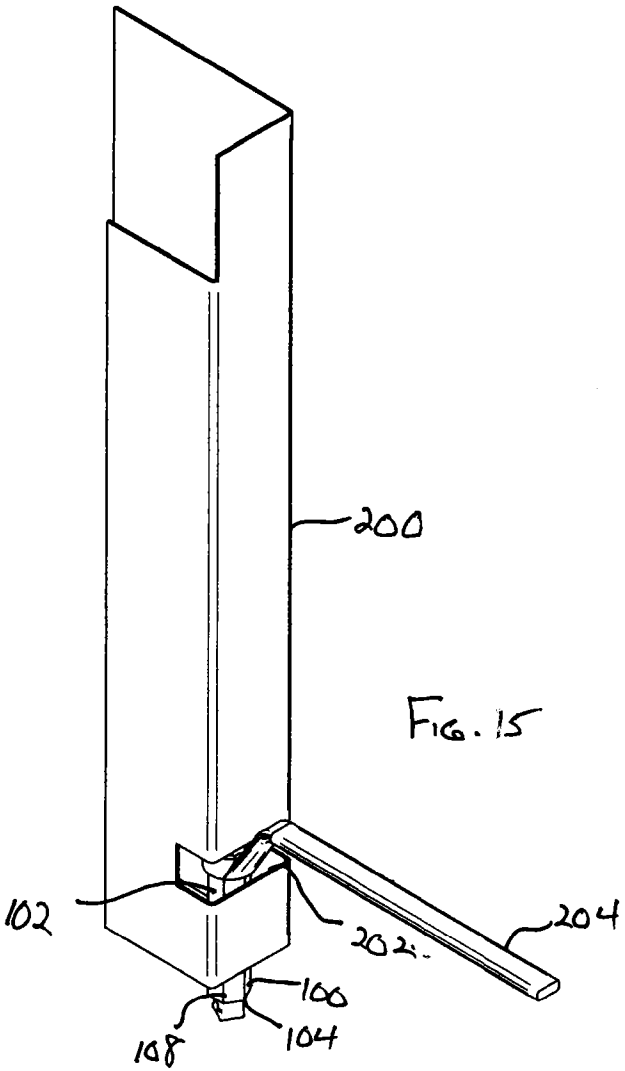
FIG. 15 is a front, perspective view of the socket extension of FIG. 1 being utilized behind a wall according to an embodiment of the present invention.

Socket extension 100 can be manipulated in a variety of ways as illustrated generally in FIGS. 9 and 10. In a first example shown in FIG. 9, socket extension 100, and more specifically, attachment aperture 122 on second end 106 can be directly engaged with a wrench protuberance 152 on a socket wrench 150. A socket 154 having a socket aperture 156 can be attached to the attachment protuberance 110 at first end 104. When socket extension 100, socket wrench 150 and socket 154 are attached, bolt 158 can be selectively loosened or tightened based upon the ratcheting configuration of the socket wrench 150. In a second example shown in FIG. 10, socket wrench 150 can be attached to the socket extension 100 with a second socket 160. An open end 162 of second socket 160 slides directly over the second end 106 such that the second socket 160 directly engages the engageable body cross-section 108. Again, when socket extension 100, socket wrench 150, socket 154 and second socket 160 are engaged, bolt 158 can be selectively loosened or tightened based upon the ratcheting configuration of the socket wrench 150.

Figure 18:
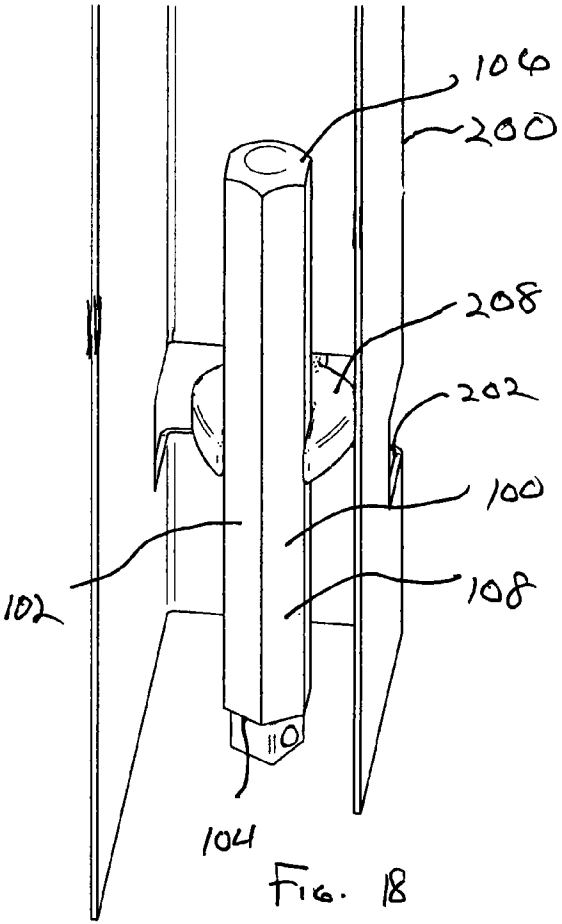
FIG. 18 is a rear, perspective view of the socket extension of FIG. 1 being utilized behind the wall of FIG. 17.
Figure 17:
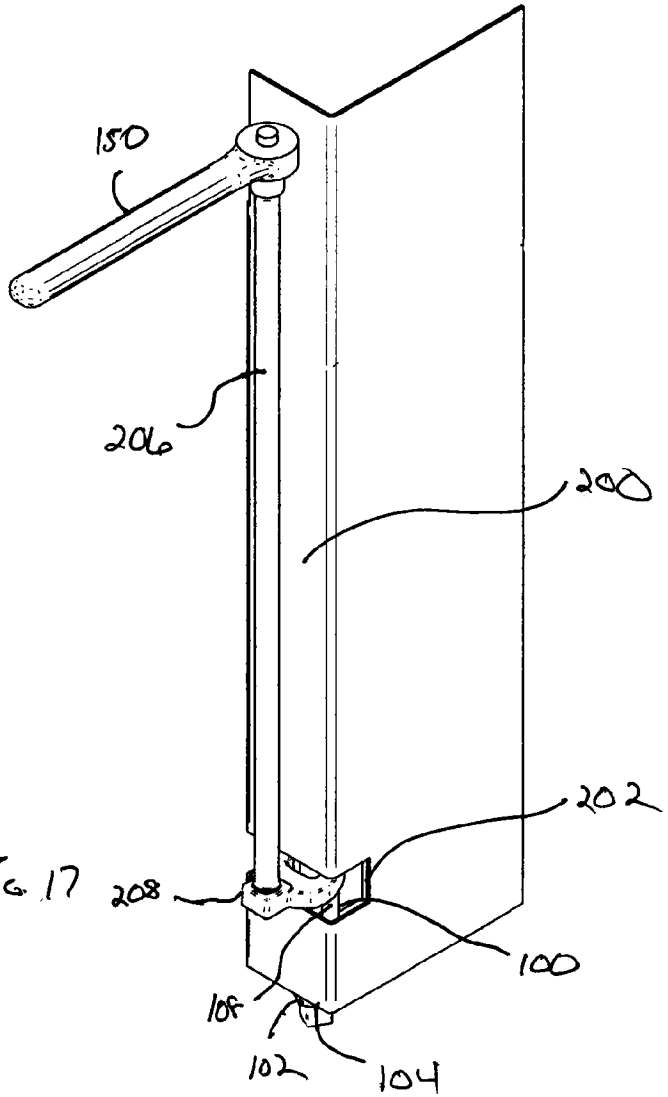
FIG. 17 is a front, perspective view of the socket extension of FIG. 1 being utilized behind a wall according to an embodiment of the present invention.

As illustrated in FIGS. 11-23, socket extension 100 provides a variety of connection options so as to accommodate unique access limitations. Referring to FIGS. 11-18, a wall structure 200 can provide a variety of access points 202 so as to provide access to bolts and/or screws located behind, below or above the wall structure 200. In one representative example shown in FIGS. 11 and 12, socket extension 100 can be positioned behind wall 200 having wall opening 202 wherein a box wrench 204 can be positioned through the wall opening 202 to engage the engageable body cross-section 108 at a convenient point along engagement length 130. As seen in FIGS. 13-16, box wrench 204 can similarly engage socket extension 100 behind different configurations of wall 200. As illustrated in FIGS. 17 and 18, socket extension 100 can be utilized with socket wrench 150 having a conventional socket extension 206 attached to a crowsfoot wrench attachment 208 so as to access nuts or bolts behind another configuration of wall 200.

Figure 19:
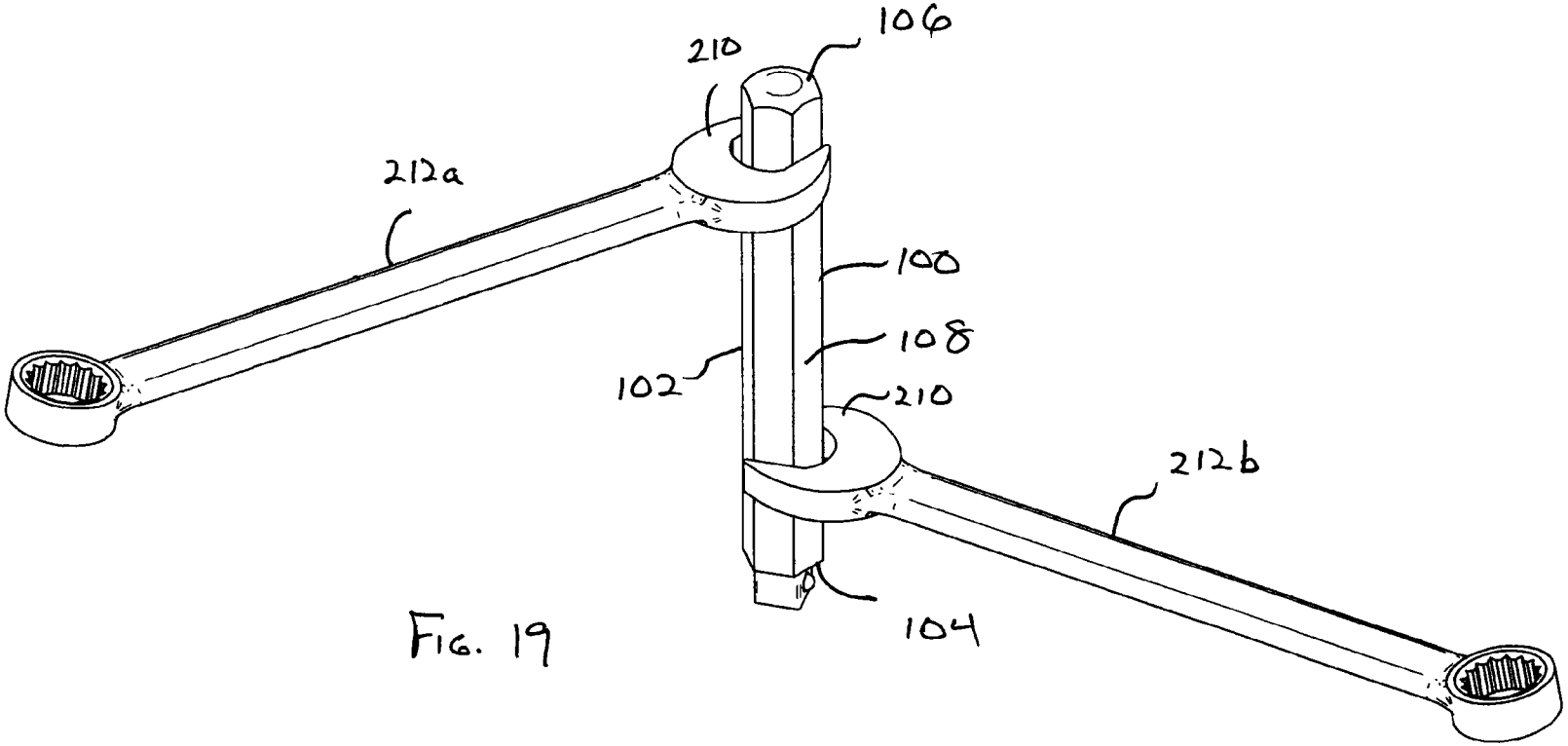
FIG. 19 is a perspective view of the socket extension of FIG. 1 being simultaneously manipulated with a plurality of tools as part of a wrench system according to an embodiment of the present invention.
Figure 20:
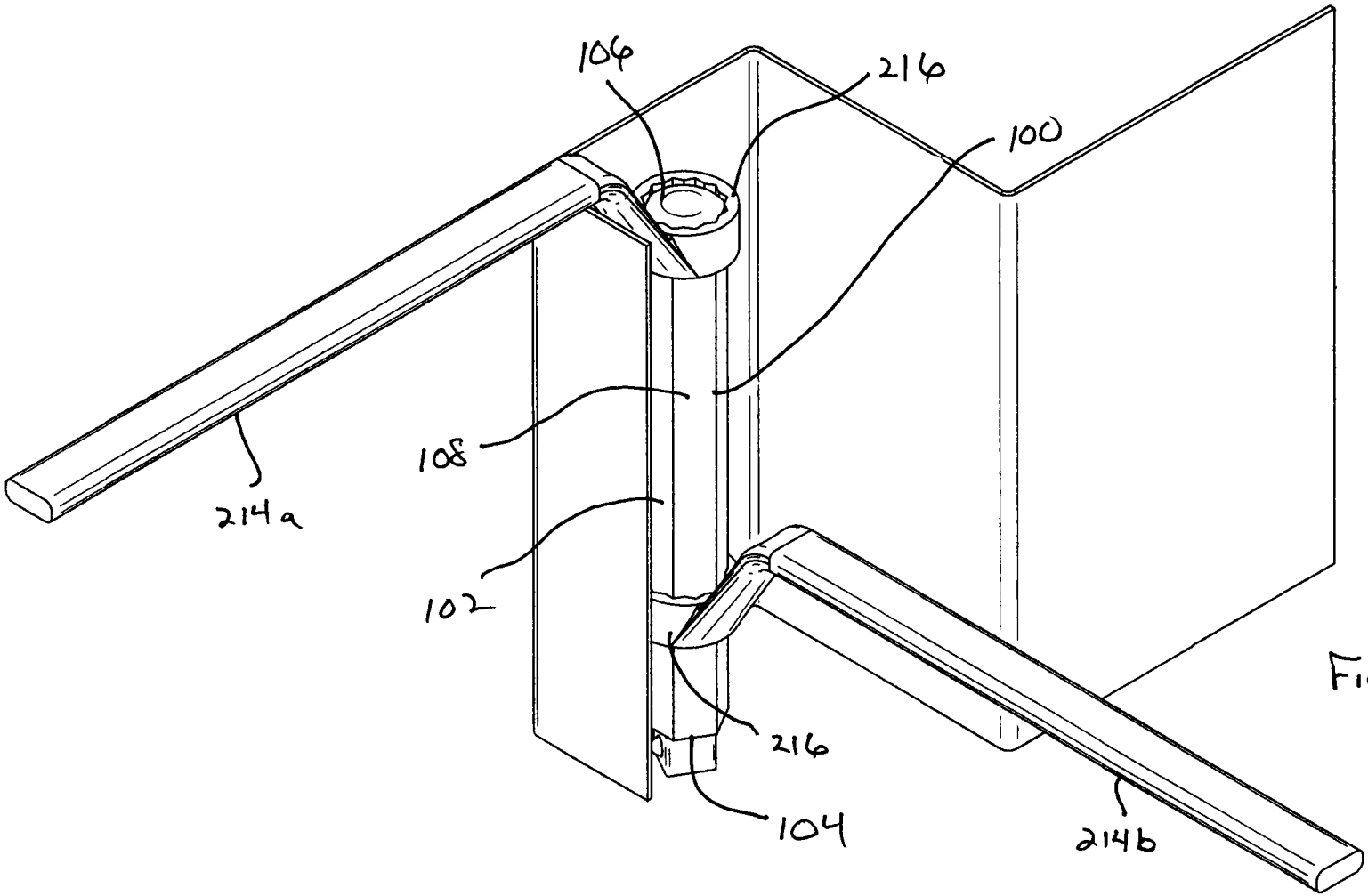
FIG. 20 is a rear, perspective view of the socket extension of FIG. 1 being utilized behind a wall and being simultaneously manipulated with a plurality of tools as part of a wrench system according to an embodiment of the present invention.
Figure 22:
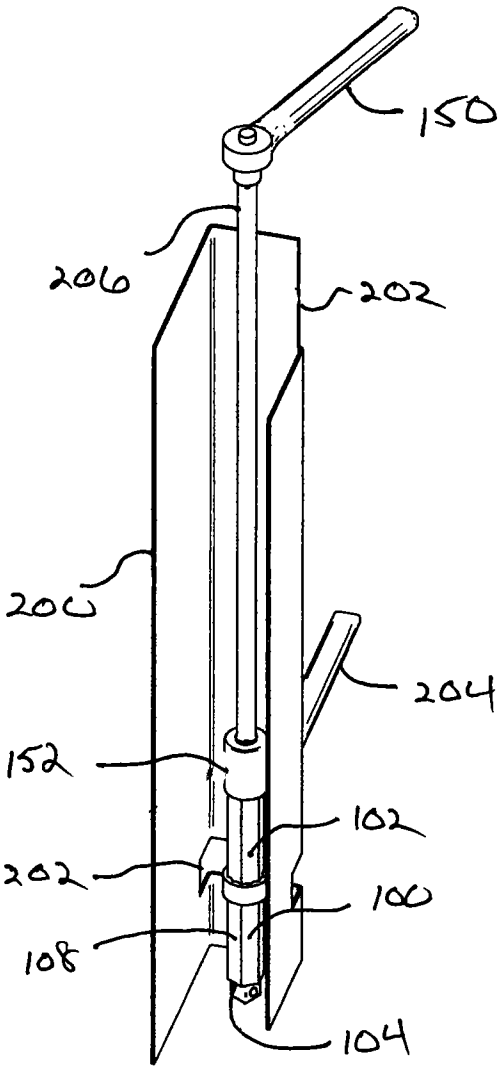
FIG. 22 is a rear, perspective view of the socket extension of FIG. 1 being utilized behind the wall of FIG. 21 and being simultaneously manipulated with the plurality of tools of FIG. 21.
Figure 21:
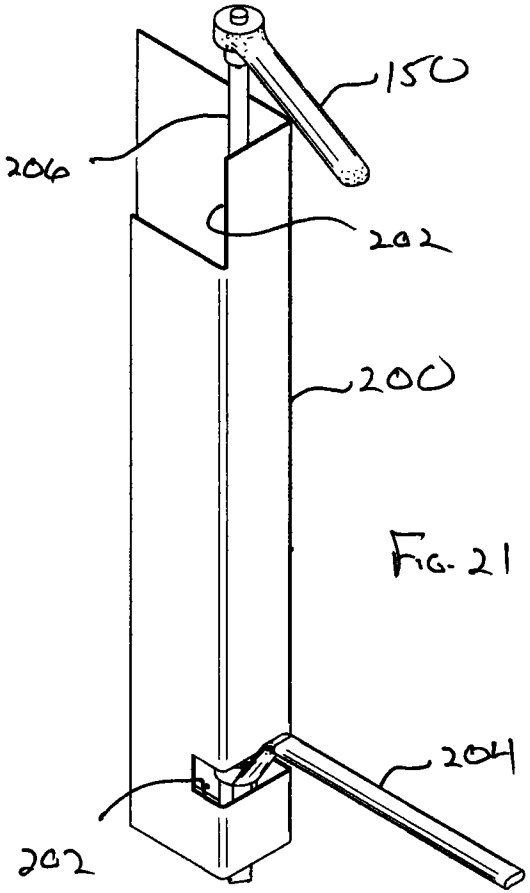
FIG. 21 is a front, perspective view of the socket extension of FIG. 1 being utilized behind a wall and being simultaneously manipulated with a plurality of tools as part of a wrench system according to an embodiment of the present invention.
Figure 23:
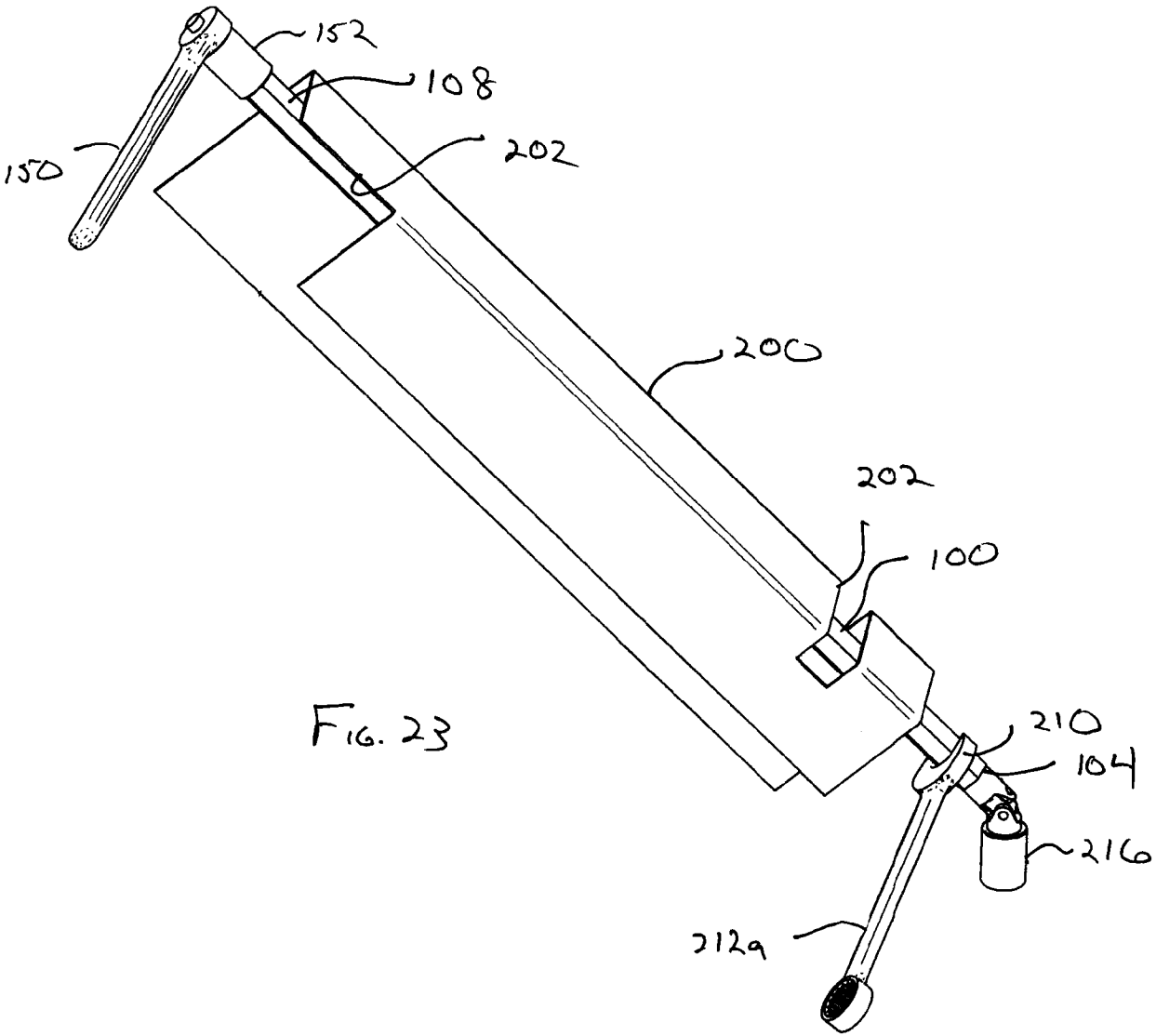
FIG. 23 is a side, perspective view of the socket extension of FIG. 1 being utilized behind a wall and being simultaneously manipulated with a plurality of tools according to an embodiment of the present invention.

In addition to allowing a user to access and manipulate difficult to reach screws/bolts behind wall 200, the ability for socket extension 100 to be engaged at any point along engagement length 130 provides the user the ability to simultaneously use a plurality of wrenches to loosen or tighten stubborn screws/bolts. With reference to FIGS. 19-23, one or more wrenches can engage the socket extension 100 to provide additional leverage or allow a second individual to assist in tightening or loosening a bolt/screw. As illustrated in FIG. 19, open ends 210 of a pair of box wrenches 212*a*, 212*b* can simultaneously engage the engageable body cross-section 108 at different locations along engagement length 130. Box wrenches 212*a*, 212*b* can be arranged so as to be offset from one another so as to allow multiple users to simultaneously apply force or to make it easier for a single user to use both hands in manipulating the socket extension 100. As demonstrated in FIG. 20, a pair of box wrenches 214*a*, 214*b* having closed ends 216 can be similarly utilized to manipulate socket extension 100 behind wall 200 while FIGS. 21 and 22 illustrate the simultaneous use of socket wrench 150 and box wrench 204 to manipulate socket extension 100. Finally, FIG. 23 illustrates the direct placement of socket wrench 150 and socket 152 specifically over second end 106 while open end 210 of box wrench 212*a* engages engageable cross-section 108 proximate the first end 104. As seen in FIG. 23, a swivel socket 216 can be directly attached to the socket extension 100 using the attachment protuberance 110 at first end 104.

The foregoing descriptions present numerous specific details that provide a thorough understanding of various embodiments of the invention. It will be apparent to one skilled in the art that various embodiments, having been disclosed herein, may be practiced without some or all of these specific details. In other instances, known components have not been described in detail in order to avoid unnecessarily obscuring the present invention. It is to be understood that even though numerous characteristics and advantages of various embodiments are set forth in the foregoing description, together with details of the structure and function of various embodiments, this disclosure is illustrative only. Other embodiments can be constructed that nevertheless employ the principles and spirit of the present invention. Accordingly, this application is intended to cover any adaptations or variations of the invention. It is manifestly intended that this invention be limited only by the following claims and equivalents thereof.

The invention claimed is:

1. A socket extension, comprising:

a shaped body having a first end and a second end, the shaped body having an engageable cross-section defined by a plurality of body sides extending continuously between the first and second end, the first end including an attachment protuberance having a plurality of sides and the second end comprising a flat surface including an attachment aperture to receive a tool attachment protuberance.

2. The socket extension of claim 1, wherein the attachment protuberance is adapted to engage a standard socket.

3. The socket extension of claim 1, wherein the engageable cross-section comprises a hexagonal cross-section.

4. A wrench system comprising:

a socket extension having a shaped body defined by a first end, a second end and an engageable cross-section extending continuously between the first and second ends, the engageable cross-section define a plurality of body sides, the first end including an attachment protuberance having a plurality of sides, the second end comprising a flat surface including an attachment aperture adapted to receive a tool attachment protuberance, and a first wrench configured to engage the socket extension at any position along shaped body.

5. The wrench system of claim 4, further comprising:

a first socket having a socket aperture, wherein the attachment protuberance is slidably insertable into the socket aperture to couple the socket extension to the socket.

6. The wrench system of claim 4, wherein the first wrench comprises a socket wrench having a wrench socket that is positionable over the flat surface to engage the shaped body.

7. The wrench system of claim 4, wherein the first wrench comprises a socket wrench having the tool attachment protuberance that is slidably insertable into the attachment aperture such that the socket wrench directly engages the shaped body.

8. The wrench system of claim 4, further comprising:

a second wrench adapted to engage the socket extension simultaneously with the first wrench, the second wrench engaging the socket extension at any position along the shaped body such that the first wrench and the second wrench engage different portions of the shaped body.

9. The wrench system of claim 8, wherein the first and second wrenches engage the shaped body such that wrench handles on each of the first and second wrenches are arranged in an offset orientation.

10. The wrench system of claim 8, wherein the first wrench engages the second end and the second wrench engages the shaped body at a point between the first end and the second end.

11. The wrench system of claim 10, wherein the first wrench comprises a socket wrench, a box wrench, an open end wrench or a crescent wrench.

12. The wrench system of claim 10, wherein the second wrench comprises a box wrench, an open end wrench or a crescent wrench.

* * * * *